United States Patent [19]

Keller

[11] Patent Number: 4,788,918

[45] Date of Patent: Dec. 6, 1988

[54] SOLIDS INCINERATION PROCESS AND SYSTEM

[75] Inventor: Michael R. Keller, Tulsa, Okla.

[73] Assignee: John Zink Company, Tulsa, Okla.

[21] Appl. No.: 123,561

[22] Filed: Nov. 20, 1987

[51] Int. Cl.[4] ..... F23J 15/00

[52] U.S. Cl. ..... 110/215; 110/165 R; 110/216; 110/259

[58] Field of Search ..... 110/203, 210, 211, 215, 110/216, 233, 234, 235, 259, 266, 150, 165 R, 171, 340

[56] References Cited

U.S. PATENT DOCUMENTS

| | | | |
|---|---|---|---|
| 2,608,527 | 8/1952 | Holland | 196/61 |
| 2,983,234 | 5/1961 | Reilly | 110/215 |
| 3,267,890 | 8/1966 | Zinn et al. . | |
| 3,315,443 | 4/1967 | Marino | 55/85 |
| 3,380,719 | 4/1968 | Murray | 261/115 |
| 3,932,280 | 1/1976 | Anderson | 110/215 X |
| 3,996,862 | 12/1976 | Besik et al. | 110/215 X |
| 4,013,455 | 3/1977 | Kleeberg et al. | 75/68 R |
| 4,019,444 | 4/1977 | Kleeberg et al. . | |
| 4,101,294 | 7/1978 | Kimura | 48/77 |
| 4,416,855 | 11/1983 | Abrams et al. | 110/215 X |

*Primary Examiner*—Steven E. Warner

*Attorney, Agent, or Firm*—Laney, Dougherty, Hessin & Beavers

[57] ABSTRACT

An improved solids incineration process and system are provided of the type wherein the solids are combusted and the resulting combustion gases are separated from combustion ash, the ash is quenched and neutralized with a quench liquid, heat is removed from the combustion gases and the combustion gases contacted with a scrubber liquid in a wet scrubber to remove fly ash therefrom. By the present invention, the spent scrubber liquid from the wet scrubber is utilized as at least a portion of the ash quench liquid.

10 Claims, 1 Drawing Sheet

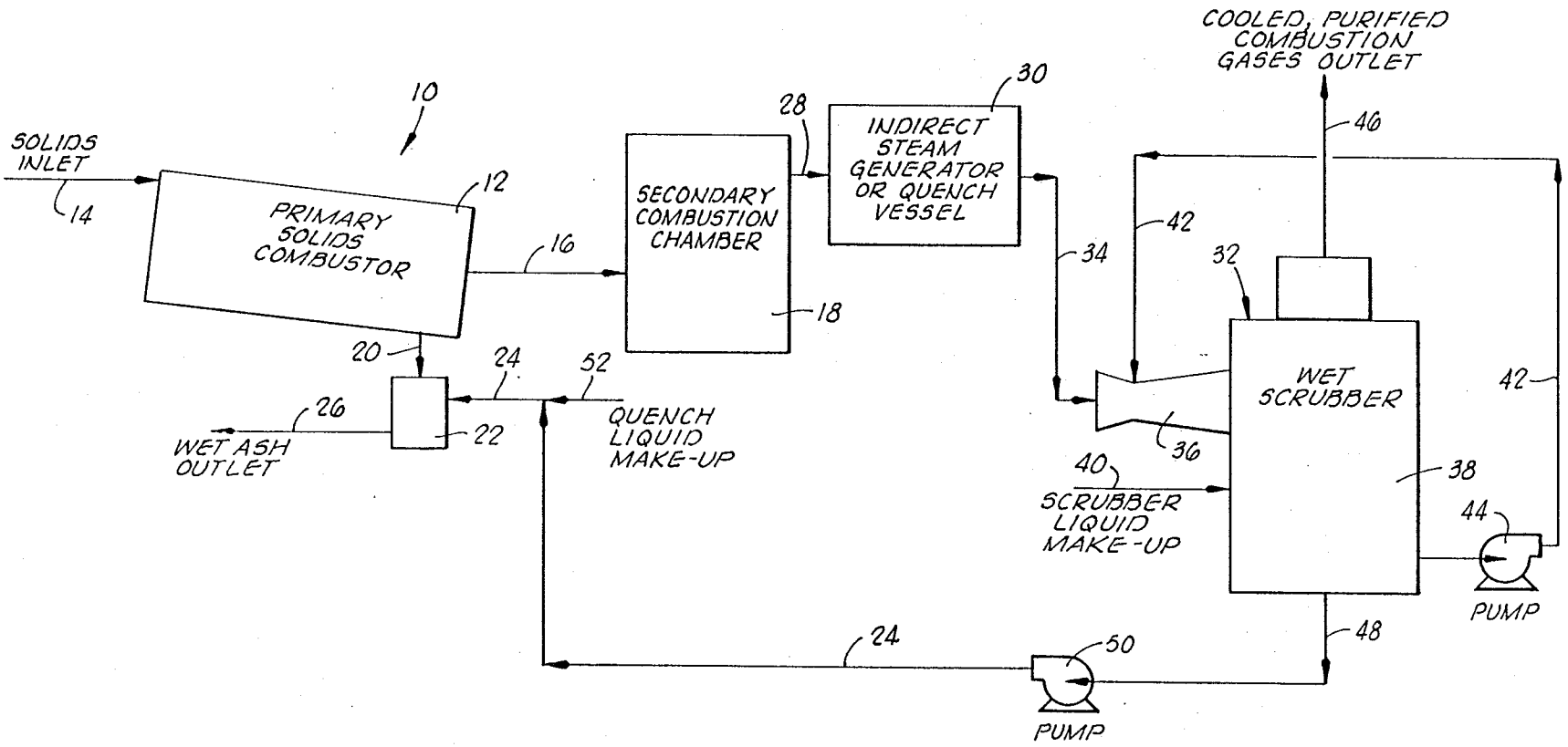
COOLED, PURIFIED COMBUSTION GASES OUTLET
46
42
WET SCRUBBER
38
44
PUMP
48
32
36
42
34
40
SCRUBBER LIQUID MAKE-UP
50
PUMP
30
INDIRECT STEAM GENERATOR OR QUENCH VESSEL
28
18
SECONDARY COMBUSTION CHAMBER
24
QUENCH LIQUID MAKE-UP
52
16
24
22
12
10
PRIMARY SOLIDS COMBUSTOR
20
26
WET ASH OUTLET
SOLIDS INLET
14

SOLIDS INCINERATION PROCESS AND SYSTEM

BACKGROUND OF THE INVENTION

1. Field of the Invention

The present invention relates to a solids incineration process and system, and more particularly, to such a process and system wherein the combustion gases produced are vented to the atmosphere with minimum pollution.

2. Brief Description of the Prior Art

The incineration of solids such as municipal solid refuse must be carried out in a system whereby the gaseous products of combustion are cooled and purified before being released to the atmosphere. In addition, the ash produced must be neutralized before being disposed of.

A commonly utilized system of the type described above includes a primary solids combustor such as a rotary kiln wherein the solids are combusted to produce combustion gases and ash. Gravity-separable ash from the primary combustor is conducted to an ash quench chamber wherein it is quenched and neutralized. The resulting neutralized wet ash is removed from the quench chamber and disposed of. The gaseous products of combustion exiting the primary combustor flow through a secondary combustion chamber wherein additional combustion takes place. The hot combustion gases are then conducted to a boiler or quench vessel wherein heat is removed therefrom followed by being conducted to a wet scrubber. In the web scrubber the combustion gases are contacted with a basic aqueous solution to remove fly ash, water soluble gases and other impurities therefrom, and the resulting cooled, purified gases are released to the atmosphere.

Heretofore, the spent scrubber liquid or blowdown from the wet scrubber has been separably disposed of and the quench liquid utilized for quenching the ash from the primary solids combustor has been from an independent source. By the present invention an improved process and system are provided whereby the spent scrubber liquid is utilized as at least a portion of the ash quench liquid.

SUMMARY OF THE INVENTION

A solids incineration process is provided wherein the solids are combusted and the resulting combustion gases are separated from combustion ash, the ash is quenched and neutralized with a quench liquid, heat is removed from the combustion gases and the combustion gases are contacted with a scrubber liquid in a wet scrubber to remove fly ash, water soluble gases and other impurities therefrom. The spent wet scrubber liquid is utilized directly as at least a portion of the ash quench liquid thereby obviating the need for the independent disposal of the spent wet scrubber liquid. A solids incineration system for carrying out the process is also provided.

It is, therefore, a general object of the present invention to provide an improved solids incineration process and system.

A further object of the present invention is the provision of an improved process and system for incinerating solids such as municipal refuse wherein the combustion gases produced are purified in a wet scrubber prior to being released to the atmosphere.

Another object of the present invention is the provision of a process and system for incinerating solids wherein the neutralization and disposal of wet ash and spent wet scrubber liquid is simplified and carried out more economically.

Other and further objects, features and advantages of the present invention will be readily apparent to those skilled in the art upon a reading of the description of preferred embodiments which follows when taken in conjunction with the accompanying drawing.

BRIEF DESCRIPTION OF THE DRAWING

In the drawing forming a part of this disclosure, the system for carrying out the process of the present invention is illustrated schematically.

DETAILED DESCRIPTION OF PREFERRED EMBODIMENTS

Referring now to the drawing, the solids incineration system of the present invention is illustrated and generally designated by the numeral 10. The system 10 includes a primary solids combustor 12 which can be a rotating kiln or other type of solids combustor wherein the gaseous products of combustion produced are gravity separated from the heavier ash produced. The solids to be incinerated enter the primary solids combustor 12 by way of a conveyor or other solids conducting means 14 connected thereto. Combustion gases from the combustor 12 are conducted by a conduit 16 to a secondary combustion chamber 18. Ash separated from the gaseous products of combustion in the combustor 12 is removed therefrom by way of a conduit 20. An ash quench chamber 22 is connected or positioned with respect to the conduit 20 to receive ash therefrom. Quench liquid is conducted to the quench chamber 22 by a conduit 24 connected thereto, and wet ash produced in the quench chamber 22 is removed therefrom by a conveyor or other conducting means 26 connected thereto.

From the secondary combustion chamber 18, the hot combustion gases are conducted by a conduit 28 to a heat removal means 30, e.g., a boiler or conventional quench vessel, wherein heat is removed from the combustion gases. The cooled combustion gases are then conducted to a wet scrubber 32 by a conduit 34.

The wet scrubber 32 can be of various types and designs, but generally includes a gas-liquid contactor section 36 connected to an accumulator 38. Scrubber liquid make-up is conducted to the accumulator 38 by a conduit 40 connected thereto, and scrubber liquid is withdrawn from the accumulator 38 by way of a conduit 42 having a pump 44 disposed therein. The conduit 42 conducts a stream of scrubber liquid to the gas-liquid contactor 36.

Cooled, purified combustion gases are conducted from the wet scrubber 32 to the atmosphere by a conduit or stack 56. A continuous or intermittent stream of spent scrubber liquid containing fly ash and other impurities removed from the combustion gases is withdrawn from the accumulator 36 by way of a conduit 48 connected thereto. The conduit 48 is in turn connected to a spent scrubber liquid pump 50, the discharge of which is connected to the conduit 24 which leads the spent scrubber liquid to the quench chamber 22. Quench liquid make-up is added to the spent scrubber liquid by way of a conduit 52 connected to the conduit 24.

In operation of the system 10 for carrying out the process of this invention, the solids to be incinerated conveyed to the primary solids combustor 12 by the conveyor 14 are combusted in the combustor 12 whereby gaseous and solid products of combustion are produced therein. The heavier solid products of combustion, generally referred to as ash, are separated by gravity from the combustion gases within the combustor 12 and are removed therefrom by way of the conduit 20. From the conduit 20 the ash enters the quench chamber 22 wherein it is cooled and neutralized by contact with an acidic aqueous quench liquid conducted thereto by the conduit 24. The resulting wet neutralized ash is removed from the quench chamber 22 for disposal by the conveyor 26.

The combustion gases from the primary solids combustor 12 are conducted by the conduit 16 to a secondary combustion chamber 18. While flowing through the secondary combustion chamber 18 the gases are combusted further, and the resulting hot stream of combustion gases is conducted therefrom by the conduit 28 to the heat removal means 30. In applications where the heat removed from the combustion gases can be economically utilized in the form of strea, the heat removal 30 is an indirect steam generator. In other applications, the means 30 can be a conventional quench vessel or other apparatus for removing heat. The resulting cooled combustion gases are conducted by the conduit 34 to the gas inlet connection of the wet scrubber 32.

In the form illustrated in the drawing, the wet scrubber 32 includes a Venturi-type of gas liquid contactor 36 wherein the combustion gases are caused to be intimately contacted by the scrubber liquid conducted thereto. Generally, the scrubber liquid is a basic aqueous solution which removes solid impurities such as fly ash, carbon particles and the like as well as water soluble gases therefrom. The mixture of scrubber liquid and combustion gases enters the accumulator 38 wherein the scrubber liquid and impurities contained therein are separated from the gases, and the resulting cooled and purified cmbustion gases are withdrawn and released to the atmosphere by way of the stack or conduit 46. Scrubber liquid make-up is added to the accumulator 38 by way of the conduit 40, and a stream of accumulated scrubber liquid is withdrawn from the accumulator 38 by way of the conduit 42 and pump 44 and conducted to the contactor 36.

A stream of spent scrubber liquid containing solids and impurities is withdrawn from the accumulator 36 by way of the conduit 48 and pump 50. The stream of spent scrubber liquid is conducted by the conduit 24 to the ash quench chamber 22 wherein it is utilized as quench liquid. Quench liquid make-up is combined with the spent scrubber liquid as required by way of the conduit 52.

Because the spent scrubber liquid is generally acidic, it contributes to the neutralization of the ash. That is, the ash from the primary combustor is typically basic in nature while the untreated spent scrubber liquid is typically acidic. The mixing of the two streams brings about the neturalization of the spent scrubber liquid and at least partial neutralization of the ash. Required additional neutralization of the ash is brought about by the quench liquid make-up, the acidity of which is adjusted accordingly.

Thus, the process and system of the present invention obviate the prior art requirement of separate steps and apparatus for neutralizing the spent scrubber liquid and independently disposing of it. In addition, by utilizing the spent scrubber liquid for quenching and partially neutralizing the ash, the total quantity of fresh acidic quench liquid required is reduced. As a result, the improved process and system of the present invention are more economical than prior art processes and apparatus.

In order to further illustrate and facilitate a clear understanding of the process and system of the present invention, the following example is given.

EXAMPLE 100 lbs. per day of particulated solids are conveyed to the combustor 12 of the incineration system 10 by the conveyor 14. The solids are combusted within the combustor 12 whereby 4125 standard cubic feet per hour of combustion gases at a temperature of 1600° F. are produced along with 16 pounds per hour of gravityseparable ash.

The combustion gases are conducted to the secondary combustion chamber 18 wherein they are further combusted and heated to a temperature of about 1800° F. While flowing through the heat removal means 30, 376,000 BTU per hour of heat are removed from the combustion gases resulting in an exit temperature of about 500° F. The combustion gases are conducted to the wet scrubber 32 wherein they are contacted with a 1200 pounds per hour stream of aqueous scrubber liquid having a pH of about 7.5. 16,000 standard cubic feet per hour of cooled, purified combustion gases at a temperature of 140° F. are released to the atmosphere.

An 85-pounds per hour scrubber liquid make-up comprised of an aqueous caustic solution having a pH of about 8 is provided to the wet scrubber 32 and a 15-pounds per hour stream of spent scrubber liquid having a pH of about 7 is withdrawn therefrom. The stream of spent scrubber liquid is introduced into the ash quench chamber 22 along with 5.5 pounds per hour of quench liquid make-up having a pH of about 6.5. The ash introduced to the ash quench chamber 22 from the solids combustor is cooled and neutralized by the quench liquid, and 30 pounds per hour of wet ash is continuously removed and disposed of.

What is claimed is:

1. A solids incineration system comprised of:

solids combustor means having a solids inlet, a combustion gases outlet and an ash outlet;

ash quench means connected to receive ash from the ash outlet of said combustor means having a quench liquid inlet and a wet ash outlet;

heat removal means for removing heat from combustion gases having an inlet and an outlet;

first conduit means connected between the combustion gases outlet of said combustor and the inlet of said heat removal means;

wet scrubber means for removing fly ash from combustion gases having a combustion gases inlet, a clean combustion gases outlet, a srubber liquid inlet and a spent scrubber liquid outlet;

second conduit means connected between the outlet of said heat removal means and the combustion gases inlet of said wet scrubber means;

third conduit means connected between the spent scrubber liquid outlet of said wet scrubber means and the quench liquid inlet of said ash quench means; and spent scrubber liquid pump means disposed in said third conduit means.

2. The system of claim 1 wherein said solids combustor means are comprised of a primary solids combustor having a solids inlet, a combustion gases outlet and an ash outlet;

an ash quench chamber connected to receive ash from the ash outlet of said primary combustor having a quench liquid inlet and a wet ash outlet;

a secondary combustion chamber having a combustion gases inlet and a combustion gases outlet; and fourth conduit means connected between the combustion gases outlet of said primary combustor and the combustion gases inlet of said secondary combustion chamber.

3. The system of claim 2 wherein said heat removal means is comprised of a heat exchanger for transferring heat from combustion gases to another process stream.

4. The system of claim 3 wherein said heat exchanger is a steam generator and said other process stream is boiler feed water.

5. A solids incineration process comprising the steps of:

(a) combusting the solids whereby combustion gases and ash are produced therefrom;

(b) separating said ash from said combustion gases;

(c) removing heat from said combustion gases;

(d) contacting said combustion gases with a basic aqueous solution to remove solid impurities and water soluble gases therefrom and thereby produce purified combustion gases and an acidic aqueous solution containing removed solid impurities;

(e) separating said acidic aqueous solution containing solid impurities from said purified combustion gases;

(f) withdrawing said purified combustion gases;

(g) mixing the ash separated in accordance with step (b) with the acidic aqueous solution containing solid impurities separated in accordance with step (e) to quench said ash and to at least partially neutralize both said ash and said acidic aqueous solution; and (h) withdrawing the neutralized mixture produced in accordance with step (g).

6. The process of claim 5 which is further characterized to include the steps of:

venting said purified gases withdrawn in accordance with step (f) to the atmosphere; and disposing of said neutralized mixture withdrawn in accordance with step (h).

7. The process of claim 5 which is further characterized to include the step of combining an aqueous acid solution with said acidic aqueous solution containing solid impurities as required to achieve neutralization in accordance with step (g) prior to carrying out step (g).

8. The process of claim 5 wherein the removal of heat from said combustion gases in accordance with step (c) is carried out by quenching said combustion gases.

9. The process of claim 5 wherein the removal of heat from said combustion gases in accordance with step (c) is carried out by indirectly transferring heat from said combustion gases to another process stream.

10. The process of claim 9 wherein said other process stream is boiler feed water.

* * * * *

UNITED STATES PATENT AND TRADEMARK OFFICE

CERTIFICATE OF CORRECTION

PATENT NO. : 4,788,918

DATED : December 6, 1988

INVENTOR(S) : Michael R. Keller

It is certified that error appears in the above-identified patent and that said Letters Patent are hereby corrected as shown below:

Column 2, line 55, change "56" to --46--;

Column 2, line 58, change "36" to --38--;

Column 3, line 20, change "strea," to --steam,--;

Column 3, line 20, after "removal" insert --means--;

Column 3, line 37, change "cmbustion" to --combustion--;

Column 3, line 45, change "36" to --38--;

Column 4, line 14, change "gravityseparable" to --gravity-separable--; and

Column 4, line 54, change "srubber" to --scrubber--.

Signed and Sealed this

Fourth Day of April, 1989

*Attest:*

*Attesting Officer*

DONALD J. QUIGG

*Commissioner of Patents and Trademarks*